US010117033B2

(12) United States Patent
Vermeiren

(10) Patent No.: US 10,117,033 B2
(45) Date of Patent: Oct. 30, 2018

(54) HEARING PROSTHESIS HAVING AN IMPLANTABLE ACTUATOR SYSTEM

(71) Applicant: Cochlear Limited, Macquarie University (AU)

(72) Inventor: Jan Vermeiren, Boechout (BE)

(73) Assignee: Cochlear Limited, Macquarie University, NSW (AU)

( * ) Notice: Subject to any disclaimer, the term of this patent is extended or adjusted under 35 U.S.C. 154(b) by 0 days.

(21) Appl. No.: 14/845,682

(22) Filed: Sep. 4, 2015

(65) Prior Publication Data

US 2015/0382117 A1 Dec. 31, 2015

Related U.S. Application Data

(63) Continuation of application No. 12/938,936, filed on Nov. 3, 2010, now Pat. No. 9,131,323.

(51) Int. Cl.
*H04R 25/00* (2006.01)
*H04R 9/02* (2006.01)

(52) U.S. Cl.
CPC ..... *H04R 25/65* (2013.01); *H04R 25/606* (2013.01); *H04R 9/027* (2013.01); *H04R 25/48* (2013.01); *H04R 25/604* (2013.01); *H04R 2225/67* (2013.01)

(58) Field of Classification Search
CPC ..... H04R 25/00–25/75; H04R 2460/13
See application file for complete search history.

(56) References Cited

U.S. PATENT DOCUMENTS 5,176,620 A 1/1993 Gilman
5,772,575 A 6/1998 Lesinski et al.
6,259,951 B1 * 7/2001 Kuzma ..... A61N 1/0541 600/25
6,390,970 B1 5/2002 Müller
6,473,651 B1 10/2002 Kuzma et al.
6,726,618 B2 4/2004 Miller
(Continued)

FOREIGN PATENT DOCUMENTS

EP 1501074 A2 1/2005

OTHER PUBLICATIONS

International Search Report and Written Opinion; International Application No. PCT/IB2011/054905 dated Apr. 27, 2012.
(Continued)

*Primary Examiner* — Thaddeus Cox
(74) *Attorney, Agent, or Firm* — Pilloff & Passino LLP; Martin J. Cosenza

(57) ABSTRACT

An implantable actuator system is disclosed. The system comprises a hermetically sealed housing; an actuator positioned in the housing, the actuator having at least one element displaceable relative to the housing; a coupling element connecting the actuator to the recipient's ear; and a diaphragm positioned at an end of the housing to provide a hermetic seal between the coupling element and the housing, wherein the diaphragm has sufficient flexibility to permit the coupling element to transmit vibrations to or from the actuator, wherein a liquid is positioned around the displaceable element of actuator to dampen the frequency response of the actuator, and in certain aspects, to make the system insensitive to differences in pressure between inside and outside of the housing.

34 Claims, 4 Drawing Sheets

(56) References Cited

U.S. PATENT DOCUMENTS

| | | | | |
|---|---|---|---|---|
| 7,180,225 | B2 | 2/2007 | Sashida et al. | |
| 7,242,786 | B2 | 7/2007 | Asnes | |
| 7,247,976 | B2 | 7/2007 | Sashida et al. | |
| 7,840,020 | B1 | 11/2010 | Miller, III et al. | |
| 9,131,323 | B2 | 9/2015 | Vermeiren | |
| 2002/0150268 | A1* | 10/2002 | Miller | H04R 25/606 381/191 |
| 2003/0055311 | A1 | 3/2003 | Neukermans et al. | |
| 2004/0097785 | A1* | 5/2004 | Schmid | H04R 25/606 600/25 |
| 2004/0148025 | A1 | 7/2004 | Schneider et al. | |
| 2005/0281432 | A1 | 12/2005 | Horigome | |
| 2006/0058573 | A1 | 3/2006 | Neisz | |
| 2006/0281963 | A1* | 12/2006 | Easter | H04R 25/606 600/25 |
| 2007/0104344 | A1* | 5/2007 | Goldberg | H04R 1/42 381/324 |
| 2008/0064918 | A1* | 3/2008 | Jolly | A61N 1/0541 600/25 |
| 2008/0075319 | A1 | 3/2008 | Kantor et al. | |
| 2008/0188707 | A1 | 8/2008 | Bernard et al. | |
| 2008/0255406 | A1* | 10/2008 | Ball | H04R 11/02 600/25 |
| 2012/0108887 | A1 | 5/2012 | Vermeiren | |
| 2013/0184629 | A1 | 7/2013 | Gurtner et al. | |

OTHER PUBLICATIONS

Nusil Technology, "MED-4901 Liquid Silicone Rubber," Life Sciences, May 16, 2014.

* cited by examiner

HEARING PROSTHESIS HAVING AN IMPLANTABLE ACTUATOR SYSTEM

The present application is a Continuation application of U.S. patent application Ser. No. 12/938,936, filed Nov. 3, 2010, naming Jan Vermeiren as an inventor, the entire contents of that application being incorporated herein by reference in its entirety.

BACKGROUND

Field of the Invention

The present invention relates generally to a hearing prosthesis, and more particularly, to a hearing prosthesis having an implantable actuator system.

Implantable hearing prostheses generally fall into one of several categories, including devices used to treat sensorineural hearing loss, devices used to treat conductive hearing loss, or devices used to treat mixed hearing loss (that is, a combination of conductive and sensorineural hearing loss). Certain such hearing prostheses include an implantable actuator system.

Implantable actuator systems include an actuator coupled to an element of a recipient's ear, such as the middle ear bones, inner ear or semicircular canal. In certain configurations, the actuator system is used to treat conductive hearing loss by generating mechanical motion of the inner ear fluid. Specifically, an actuator converts an electrical signal into a mechanical vibration. This vibration is delivered to the appropriate element of the recipient's ear via a coupling element. In other configurations, the actuator functions as an implantable microphone that converts vibrations of a recipient's middle ear, inner ear, semicircular canals, etc., into electrical signals.

SUMMARY

In one aspect of the present invention, an actuator system implantable in a recipient is provided. The system comprises: a hermetically sealed housing; an actuator positioned in the housing and having at least one element displaceable relative to the housing; a coupling element connecting the actuator to the recipient's ear; and a diaphragm positioned at an end of the housing to provide a hermetic seal between the coupling element and the housing, wherein the diaphragm has sufficient flexibility to permit the coupling element to transmit vibrations to or from the actuator, and wherein a liquid is disposed around the displaceable element of the actuator to dampen the frequency response of the actuator.

In another aspect of the present invention, a method for mechanically stimulating a recipient's ear with a hearing prosthesis having an implantable actuator system comprising an actuator having at least one displaceable element positioned in a hermetically sealed housing, and a coupling element connecting the actuator to an element of the recipient's ear is provided. The method comprises: generating an electrical signal based on a received sound; generating motion of the displaceable element of the actuator in response to the generated electrical signal; and damping the motion of the displaceable element with a liquid disposed around the displaceable element.

In a still other aspect of the present invention, a system for mechanically stimulating a recipient's ear with a hearing prosthesis having an implantable actuator system comprising an actuator having at least one displaceable element positioned in a hermetically sealed housing, and a coupling element connecting the actuator to an element of the recipient's ear is provided. The system comprises: means for generating an electrical signal based on a received sound; means for generating motion of the displaceable element of the actuator in response to the generated electrical signal; and means for damping the motion of the displaceable element with a liquid disposed around the displaceable element.

BRIEF DESCRIPTION OF THE DRAWINGS

Embodiments of the present invention are described below with reference to the attached drawings, in which.

DETAILED DESCRIPTION

Aspects of the present invention are generally directed to an implantable actuator system comprising a hermetically sealed housing having an actuator connected to a recipient's ear by a coupling element. The actuator includes at least one element that is physically displaceable relative to the housing, and a liquid is disposed at least around the displaceable element to dampen the motion of the element. In certain embodiments, the actuator vibrates the recipient's ear in response to a received electrical signal. In other embodiments, the actuator receives a vibration from the recipient's ear, and outputs an electrical signal based on the received vibration. As described in greater detail below, a liquid disposed at least around the displaceable element of the actuator may provide a more uniform frequency response so as to reduce the risk of over stimulation, and may mitigate susceptibility to external atmospheric pressure variations.

Figure 1:
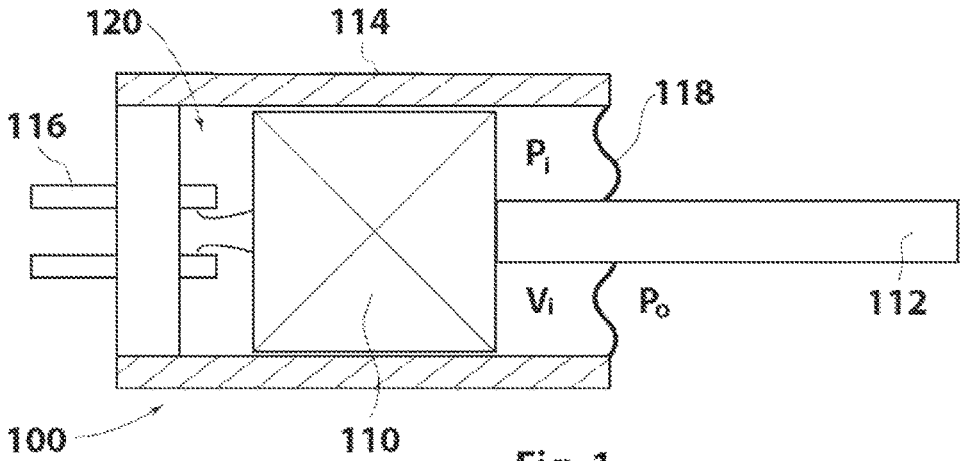
FIG. 1 is a side, cross-sectional view of an implantable actuator system for use in an implantable hearing prosthesis, in accordance with embodiments of the present invention.

FIG. 1 illustrates an implantable acoustic actuator system 100 comprising an actuator 110 in the form of a vibrator 110. Specifically, vibrator 110 may be, for example, an electromechanical or piezoelectric device configured to generate vibration based on a received electrical signal. Vibrator 110 is positioned in a hermetically sealed housing 114, and a hermetic feedthrough 116 allows electrical signals to enter/exit the housing. Actuator system 100 also includes a coupling element 112 extending from the housing, and that connects vibrator 110 to the recipient's ear. Coupling element 112 may be attached to, for example, the bones of a recipient's middle ear, the inner ear, semicircular canals, etc. A diaphragm 118 is positioned around coupling element 112 at one end of the housing, provides a hermetic seal between housing 114 and the external surface of coupling element 112.

In order for vibrations from vibrator 100 to travel to the recipient's ear, diaphragm 118 is substantially flexible so as to allow sufficient longitudinal travel of coupling element 112. However, due to the hermetical seal provided by housing 114 and diaphragm 118, the internal volume ($V_i$) of any fluid inside the housing 114 is isolated from the outside of housing 114, and is at a certain pressure $P_i$. In certain circumstances, housing 114 is substantially filled with a liquid 120 such that there is substantially no gas in housing 114.

The ambient pressure ($P_o$) outside housing 114 is subject to variations as a result of, for example, changes in altitude, diving, mountain climbing, airplane travel, weather conditions etc. Changes in $P_o$ affect the flexibility of diaphragm 118 of actuator system 100. More particularly, if housing 114 is filled with a gas, rather than a liquid 120, the static pressure variations result in a pressure difference between the gas inside the housing and ambient environment. That is, if the internal pressure $P_i$ is greater than the external pressure $P_o$, diaphragm 118 will deflect away from housing 114 in an attempt to equalize the pressure, thereby increasing the volume $V_i$ of the housing. However, if the internal pressure $P_i$ is less than the external pressure $P_o$, diaphragm 118 will deflect in to housing 114, decreasing the volume $V_i$ of housing 114.

The mechanical properties and behavior of diaphragm 118, specifically the stiffness of the diaphragm, are altered as a result of this deformation. The resonance frequency of a mechanical structure is proportional to the square root of the stiffness of the structure. Therefore, because diaphragm 118 is attached to coupling 112 and vibrator 110, a change in the stiffness of the diaphragm will also cause a change in the resonance frequency of the implantable actuator system 100. In other words, the resonance frequency of the actuator system is a function of the internal and ambient pressure difference.

Figure 2:
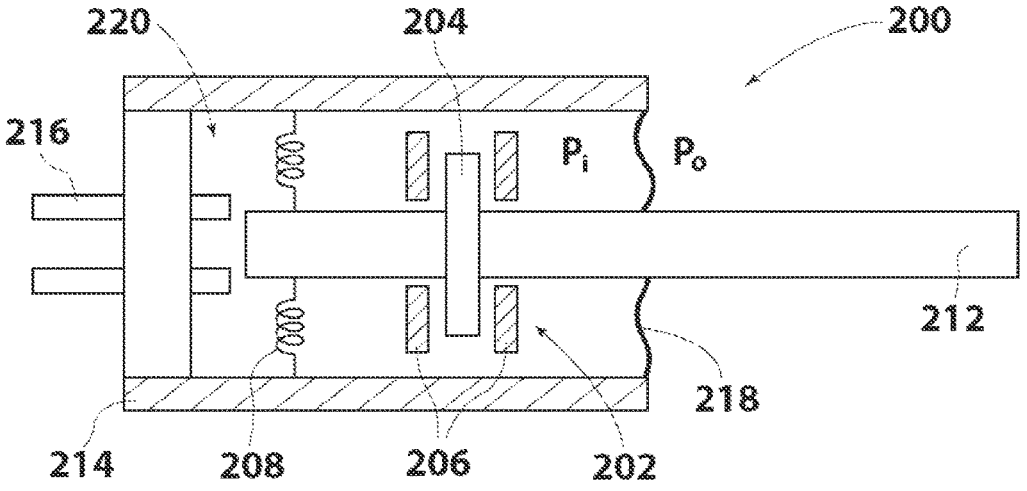
FIG. 2 is a side, cross-sectional view of an alternative actuator system for use in an implantable hearing prosthesis, in accordance with embodiments of the present invention.

FIG. 2 illustrates an implantable actuator system 200 in accordance with embodiments of the present invention. As shown, system 200 includes an electro-mechanical vibrator 202, having an armature 204, one or more permanent magnets 206 and a longitudinal resilient device 208, such as a spring. Similar to the embodiments of FIG. 1, actuator system 200 includes a coupling element 212 connecting vibrator 202 to the recipient's ear, a housing 214, feedthrough 216 and diaphragm 218.

In the embodiments of FIG. 2, vibrator 202 operates in accordance with the balanced armature principle. More specifically, vibrator 202 includes a displaceable or moveable element, referred to as armature 204, that is attached to coupling 212. Armature 204 is configured to move in the magnetic field created by permanent magnets 206. When armature 204 is centered in the magnetic field, there is no net force on the armature, and thus armature 204 is in magnetic equilibrium within the two magnets 206 and is in a "balanced" position. As such, an important factor in maintaining the balance of vibrator 202 is the proper position of the armature 204 between the magnets 206.

Embodiments of the present invention are described with reference to an electromagnetic vibrator having two magnets. It would be appreciated that, in alternative embodiments of the present invention, the electromagnetic vibrator may have a single magnet, or more than two magnets.

As noted above, changes in static pressure cause a pressure difference between $P_i$ and $P_o$, that, if housing 214 was filled with a gas, causes diaphragm 218 to deform, thereby changing the stiffness of the diaphragm. Because coupling element 212 is hermetically sealed to diaphragm 218, and because armature 204 in vibrator 202 is also connected to coupling element 212, changes in stiffness of the diaphragm causes changes the position of armature 204 between the magnets 206. As previously noted, armature 204 must be correctly positioned between magnets 206. Therefore, any change of armature position forces armature 204 to be closer to one of the two magnets 206, thereby increasing the magnet attraction force, and forcing the armature 204 to move further from its balanced position.

Any movement of armature 204 from magnetic equilibrium affects the actuator resonance frequency. For example, Laser Doppler Vibrometer (LDV) measurements on actuators in changing pressure conditions show a 300 Hz resonance frequency shift in normal static pressure variations due to changing weather conditions when a housing is gas filled.

To substantially prevent armature 204 from being forced from the balanced position, in the embodiments of FIG. 2 housing 214 is at least partially filled with a substantially non-compressible liquid 220. In certain embodiments, liquid 220 fills housing 214 such that there is no gas remaining within the housing. The presence of liquid 220 prevents changes in static pressure $P_o$ from impacting on the volume of housing 214 and, therefore, the position of the diaphragm 218 and armature 204 are not altered.

In embodiments of the present invention, liquid 220 has a low viscosity, is electrically non-conductive, and is non-poisonous. For example, in specific embodiments, liquid 220 may be a biocompatible silicone fluid having sufficiently low viscosity. As noted above, liquid 220 is substantially non-compressible, (that is, the compressibility of a liquid is sufficiently small when compared with a gas to be considered negligible), and more viscous than a gas. As described below, the inclusion of liquid 220 affects the frequency response of actuator system 200.

In the embodiments described above, the viscosity of liquid 220 creates a damping effect on the movement of armature 204 and, therefore, reduces the resonance peak, creating a substantially flat transfer function. That is, the transfer function does not include large peaks. Secondly, because liquid 220 is substantially non-compressible, varying ambient pressures will not impact on the stiffness of the diaphragm, and thus will not result in changes in the resonance of the actuator resulting from displacement of armature 204. Changes in the transfer function are thus minimized.

Figure 3:
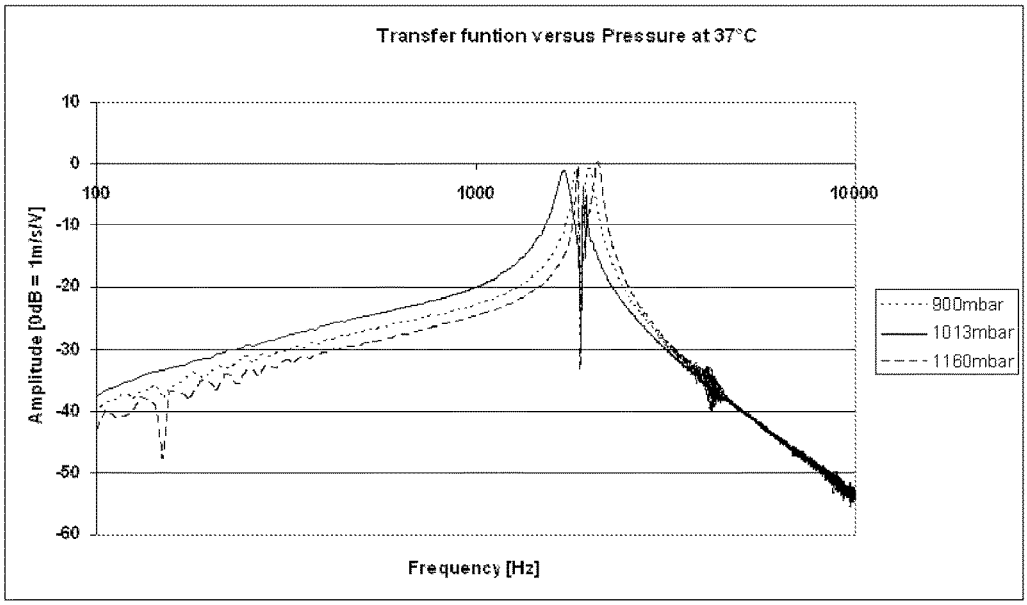
FIG. 3 is a graph illustrating the frequency response of an actuator system when the system housing is filled with a gas.

FIG. 3 is a graph illustrates the transfer function of a conventional actuator system having a housing filled with a gas, and the behavior of the system with respect to varying ambient pressure at 37° C. An analysis of the graph provides two general observations: (1) there is a sharp resonance peak around 2 kHz; and (2) the resonance peak shifts as the static ambient pressure changes.

The sharp resonance peak may result in over stimulation of the recipient's ear at the specific range of the audio spectrum in which the peak occurs. This requires calibration of the system for each individual implant. That is, the system must be calibrated in order to transfer less energy in the region of the resonance peak to avoid over stimulation of the recipient.

The shifting resonance peak causes a second problem that cannot be corrected through calibration. Specifically, as noted above, the system is calibrated for each recipient so as to account for a particular resonance peak occurring in a particular region of the audible spectrum. If the resonance peak shifts outside the region for which it has been calibrated, the calibrated region may be overly suppressed, as there is no longer a "peak" there. Additionally, because the resonance peak is now in a region which it has not been accounted for, the recipient may again be over stimulated.

Figure 4:
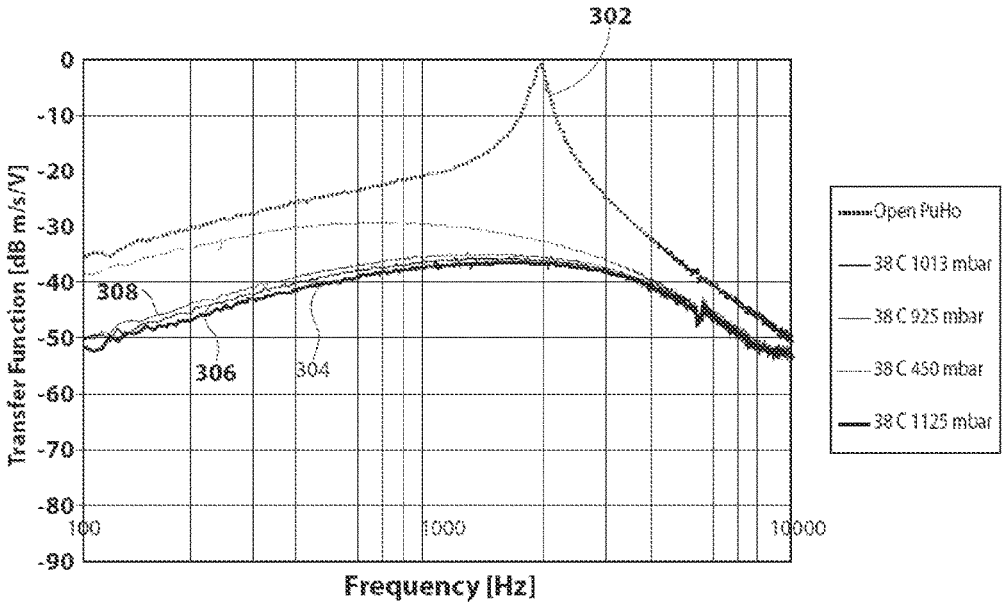
FIG. 4 is a graph illustrating the frequency response of an actuator system when the system housing is filled with a liquid.

FIG. 4 is a graph illustrating the output transfer function of an actuator system filled with a mineral oil to dampen the movement of a displaceable element. In FIG. 4, line 302 represents the transfer function of an actuator system that does not use fluid damping, and is provided for comparison purposes. Line 304 represents the actuator transfer function of an actuator system when the housing is filled with a mineral oil, and the ambient pressure outside the housing is at 1125 mbar. Similarly, line 306 represents the actuator transfer function of actuator system 200 when filled with a mineral oil, and the ambient pressure is 1013 mbar. Similarly, line 308 represents the transfer function when the housing is filled with a mineral oil and the ambient pressure is 925 mbar. At sea level, the extremes of variance in atmospheric pressure would be between approximately 870 mbar and 1100 mbar. As can be seen in FIG. 4, outputs 304 to 308, all of which are substantially within this range, are very similar in that they do not include extreme resonance peaks. Although a recipient's perception of sound may change, there are no resonance peaks which may cause over stimulation of the recipient. As such, individual calibration of an actuator to its resonance frequency is not required.

From the response shown in FIG. 4, it is possible to see the surprising advantage that embodiments of the present invention may be useful for any kind of implantable actuator that suffers from issues of resonance peaks. That is, embodiments of the present invention are not limited to actuators that suffer from issues of varying atmospheric pressures, for example, but rather may benefit, for example, a transcutaneous bone anchored hearing device or any other implantable acoustic actuator that does not have a flexible construction on which the static pressure changes have impact. Additionally, it can be seen from FIG. 4 that variation of atmospheric pressure (to the extremes of ±100 mbar) has a minor impact on the output transfer function, whereas the same variation on a non-liquid filled actuator shifts the resonance frequency as much as 300 Hz.

Embodiments of the present invention have been described above with respect to a actuator system having a housing that is substantially filled with a liquid. That is, the housing contains no, or a relatively small amount, of gas. In an alternative actuator system using a electromechanical vibrator, the housing is partially filled with a liquid. In certain embodiments, a ferro-liquid fills only the region of the magnets, and not the entire housing. Specifically, because the ferro-liquid becomes strongly magnetized in the presence of a magnetic field, the magnetic field will retain the liquid around the armature between the magnets. In this case, the effect would be damping only, removing resonance peaks, as the internal volume of gas would still be subject to atmospheric pressure differences.

Figure 5:
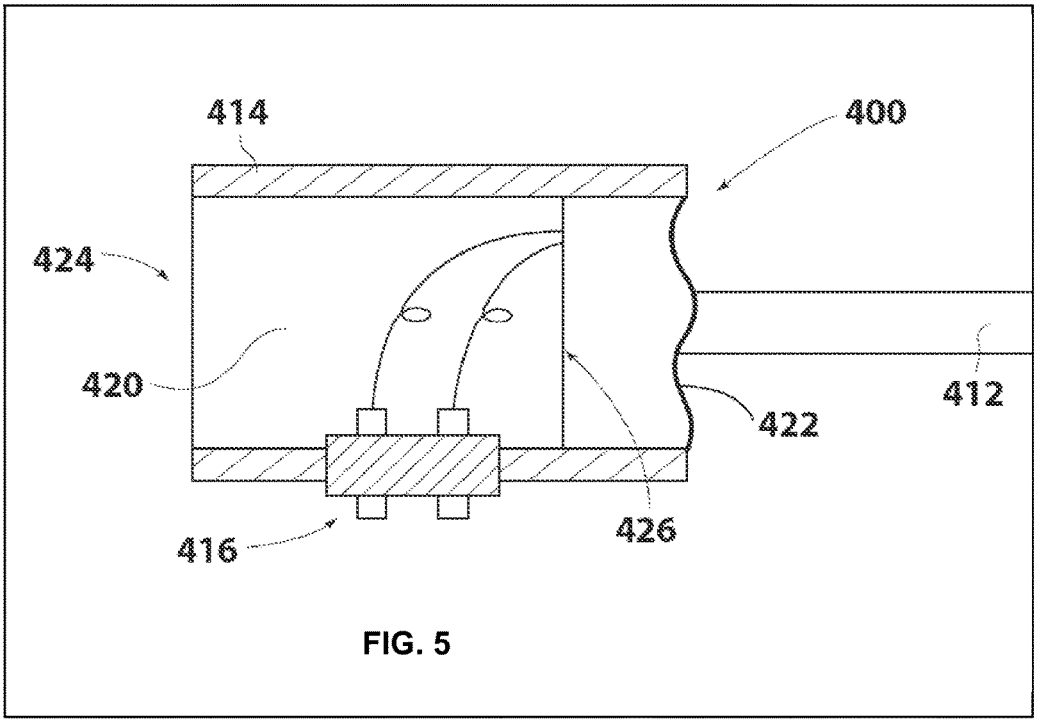
FIG. 5 is a side, cross-sectional view of an implantable microphone for use in an implantable hearing prosthesis in accordance with one embodiment of the present invention.

As previously noted, embodiments of the present invention may be applied to an acoustic actuator operating as an implantable microphone. FIG. 5 is cross-sectional view of an exemplary microphone 400 implementing embodiments of the present invention. Microphone 400 is effectively a hydrophone. That is, the sensing element of microphone 400 is sensitive to pressure waves in liquids.

Microphone 400 has a coupling element 412, a housing 414 filled with a liquid 420. The housing includes a hermetic feedthrough element 416. Coupling element 412 is attached with any vibrating structure of the middle or inner ear. The vibration is conducted from coupling element 412 through a first flexible diaphragm 422, moving the liquid inside housing 414. The other end of the housing 414 has a second diaphragm 424 with the same stiffness as the first diaphragm 422. This second diaphragm allows the vibrations to travel through liquid 420. If the second diaphragm was not present, the substantial incompressibility of the liquid would reduce the amplitude of the vibrations transmitted through the liquid to the microphone.

Inside housing 414 is a microphone element 426 sensitive to the vibrations. In this example, the element 426 is a piezo-electric material, which does not require air pressure changes as input, but instead operates on the deflections caused by vibrations in the liquid 420. Specifically, in embodiment a PVDF (polyvinylidene fluoride) co-polymer film having a strong piezo-electric response, and acoustic impedance that substantially matches the acoustic impedance of water may be used as element 426. Element 426 converts the sound vibrations transmitted through the liquid 420 into an electrical signal. The electrical signal can be transferred through the hermetic feedthrough 416 to implanted electronics (not shown). The main advantage of using a hydrophone is avoiding pressure dependency by the use of a substantially non-compressible liquid instead of a gas.

Although embodiments of FIG. 5 have been described with use of PVDF it would be appreciated that other co-polymers of PVDF, such as P(VdF-TrFE), a co-polymer of PVDF with Trifloroethylene, having piezo-electric responses may also be used. In particular, these materials have the advantage of exhibiting strong piezo- and pyro-electric response, and have an acoustic impedance that is much closer to water than conventional piezo-ceramic materials. In addition, PVDF and similar materials are chemically resistant and mechanically resilient. The piezo-electric properties of the film degrade above around 60° C., and as this embodiment is intended to be implanted in the human body, would only be exposed to around 37° C. It would also be appreciated that a number of different materials may be used, and that embodiments of the present invention are not limited to the embodiments noted above.

As previously noted, providing an implantable actuator system having a housing substantially filled with liquid provides several advantages. However, substantially filling the housing with a liquid has the added advantage that it removes a time consuming process of manufacture. When manufacturing prior art implantable actuator systems, the systems are generally hermetically sealed in a step known as the bake out process. This process ensures that internal volume is completely dry, thereby avoiding internal corrosion and/or degradation of electronic components. In the bake out process, the actuator system is heated to an elevated temperature in a vacuum for a long duration, such as several hours. This creates a completely dry atmosphere as any liquid vaporizes and is exhausted by the vacuum. After this step, the actuator is backfilled with a dry gas, such as helium, to a certain pressure (such as, for example, average sea level atmospheric pressure at 37° C.). This step is very time consuming and difficult to control and validate. By filling the actuator with a liquid, especially, for example, an oil, no additional corrosion protection is necessary.

Figure 6:
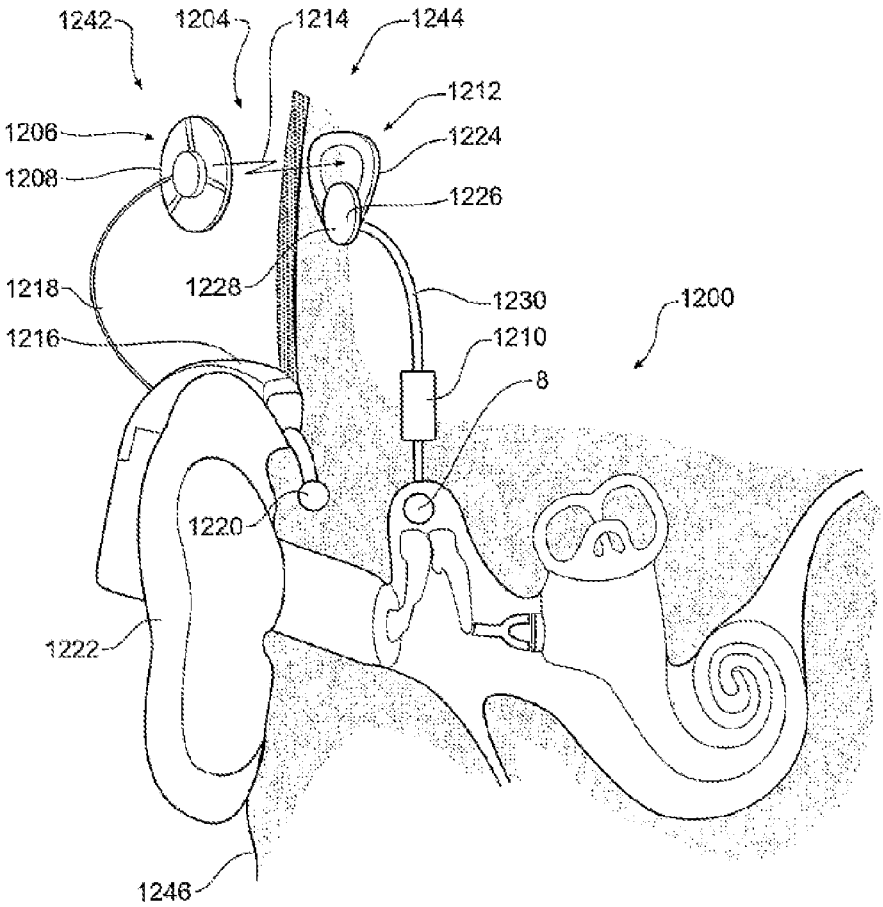
FIG. 6 is a perspective view of an implantable hearing prosthesis comprising an actuator system in accordance with one embodiment of the present invention.

FIG. 6, is a perspective view of implantable hearing prosthesis 1200 having an actuator system 1210 in accordance with embodiments of the present invention. As shown, hearing prosthesis 1200 is implanted in a recipient and is a middle ear implant.

Hearing prosthesis 1200 comprises an external component assembly 1242 which is directly or indirectly attached to the body of the recipient, and an internal component assembly 1244 which is implanted in the recipient. External assembly 1242 typically comprises one or more audio pickup devices 1220 for detecting sound, a speech processing unit 1216, a power source (not shown), and an external transmitter unit 1206 comprising an external coil 1208. Speech processing unit 1216 processes the output of audio pickup devices 1220, and generates coded signals which are provided to external transmitter unit 1206 via cable 1218.

Internal component assembly 1244 comprises an internal receiver unit 1212, a stimulator unit 1226, and an actuator system 1210. Internal receiver unit 1212 comprises an internal coil 1224 that is inductively coupled to external coil. That is, internal coil 1224 and external coil 1208 form an inductively-coupled coil system used to transfer data and power via a radio frequency (RF) link 1214.

Internal component assembly 1244 also includes a stimulator unit 1226 sealed within a housing 1228. A cable 1230 extends from stimulator unit 1226 to actuator system 1210. Actuator system 1210 is implemented as described above with reference to FIG. 1 or 2.

Actuator system 1210 is coupled to the recipient's inner ear fluids via artificial incus 8 extending through a cochleostomy. Specifically, electrical signals generated by stimulator unit 1226 are delivered to actuator system 1210 that vibrates artificial incus 8. The vibration of artificial incus 8 results in motion of the inner ear fluid.

It would be appreciated that embodiments of FIG. 6 are schematic representations only, and that embodiments of the electromechanical actuator system 1210 may be positioned in a variety of locations to evoke a hearing percept. For example, in alternative embodiments, a variety of stapes prostheses may be attached to artificial incus 8, actuator system 1210 may be coupled to a recipient's middle ear bones, skull, etc. It would also be appreciated that actuator system 1210 may be secured to the recipient utilizing a variety of techniques now or later developed.

As noted elsewhere herein, embodiments of the present invention may be used in devices used to treat conductive hearing loss, as well as in actuator systems designed to provide sufficiently high output levels so as to treat severe sensorineural hearing loss. Embodiments of the present invention are designed to treat such hearing loss while being sufficiently small to completely fit into a human mastoid. For example, actuator systems in accordance with embodiments of the present invention may be implemented in a cochlear implant system, hearing aid or other medical devices or systems now or later developed. These implantable medical devices can be either partially or totally implanted in an individual, and such implantation may be temporary or permanent. In one specific implementation, the actuator system is part of a direct acoustical cochlear system (DACS), as disclosed in US patent application US20080188707, the contents of which are hereby incorporated by reference herein.

As noted above, embodiments of the present invention may use an electromagnetic or piezo-electric actuator. A piezo-electric actuator may have a displaceable element comprises a portion of piezo-electric material, such as a piezo-electric film or stack. The piezo-electric material is displaceable in that, as known, piezo-electric material mechanically deforms in response to an electrical signal, or generates an electrical signal in response to a mechanical deformation. In either circumstance, a mechanical deformation occurs and the element is referred to herein as being displaceable.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart there from.

The invention claimed is:

1. An implantable device implantable in a recipient, comprising:

a sealed housing;

an actuator assembly positioned in the housing and having at least one element displaceable relative to the housing; and a displaceable material that is located between an interior wall of the device and a component of the actuator assembly, wherein the component of the actuator assembly is displaceable relative to the interior wall of the device, and wherein the displaceable material is displaced upon movement of at least a portion of the actuator assembly relative to the interior wall of the device, wherein the device is configured to transfer vibrational energy from inside the housing to outside the housing via a solid transduction medium.

2. The implantable device of claim 1, wherein:

the displaceable material dampens the actuator assembly.

3. The implantable device of claim 1, wherein:

the displaceable material dampens a frequency response of the actuator assembly.

4. The implantable device of claim 1, wherein:

structure extends from the actuator assembly, through the housing, to an outside of the housing, wherein the structure is configured to transmit vibrations generated by the actuator assembly to bone of the recipient.

5. The implantable device of claim 1, wherein:

the actuator assembly is configured to vibrate upon application of an electrical signal thereto;

the implantable device is configured such that the displaceable material is confined in its entirety inside the sealed housing; and portions of the actuator assembly to which the electrical signal is applied move upon the application of the electrical signal thereto.

6. The implantable device of claim 1, wherein:

the housing is such that a cross section therethrough lying on a plane lying on a longitudinal axis of the housing includes an upper wall section and a bottom wall section, the sections having substantial portions thereof parallel to one another;

an interior space is located within the housing;

the actuator assembly is positioned in the interior space facing at least one surface of the interior wall, wherein the at least one surface establishes a boundary of the interior space;

the displaceable material is located between the at least one surface and the component of the actuator assembly;

the component of the actuator assembly is displaceable relative to the at least one surface; and the displaceable material is displaced upon movement of at least a portion of the actuator assembly relative to the at least one wall surface with all of the displaceable material remaining in the interior space.

7. The implantable device of claim 1, wherein:

the interior wall of the implantable device is fixed relative to the housing and the at least one element displaceable relative to the housing is reciprocatingly displaceable along a path extending respectively towards and away from the interior wall that is fixed relative to the housing such that the displaceable material is displaced from a location along the path when the at least one element is displaced such that the at least one element moves towards the interior wall of the implantable device that is fixed while all of the displaceable material is retained within the housing; and the seal of the housing is hermetic such that the actuator assembly is hermetically isolated from tissue of the recipient.

8. The implantable device of claim 1, wherein:

the implantable device is a transcutaneous bone anchored hearing device configured to output vibrational energy to tissue of a recipient via solid body force transfer.

9. The implantable device of claim 1, wherein:

the actuator assembly includes a transducer element;

a bounded volume is established in part by the interior wall, wherein the bounded volume is hermetically sealed such that all of the displaceable material is completely confined in the bounded volume and the transducer element is within the volume.

10. The implantable device of claim 1, wherein:

the device is configured to transfer vibrational energy from inside the housing to outside the housing via only solid medium(s).

11. The implantable device of claim 1, wherein:

the device is configured to transfer vibrational energy from inside the housing to outside the housing via a solid medium to which the actuator directs the vibrational energy.

12. The implantable device of claim 1, wherein:

the actuator assembly is configured to vibrate upon application of an electrical signal thereto;

the housing is hermetically sealed;

the implantable device is configured such that the displaceable material is hermetically located in its entirety inside the sealed housing; and portions of the actuator assembly to which the electrical signal is applied move upon the application of the electrical signal thereto.

13. The implantable device of claim 1, wherein:

the actuator assembly is configured to vibrate upon application of an electrical signal thereto;

the implantable device is configured such that the displaceable material is located in its entirety inside the housing such that the displaceable material is in a fixed mass state; and portions of the actuator assembly to which the electrical signal is applied move upon the application of the electrical signal thereto.

14. An implantable device implantable in a recipient, comprising:

a sealed housing; and an actuator assembly having at least one element displaceable relative to the housing, and at least one second element fixed relative to the housing, wherein an internal volume is located within the sealed housing defined by internal surfaces of the device, which internal volume is hermetically sealed, the actuator assembly is positioned in the internal volume, the internal volume is devoid of gas at a location defined by a direct line between a surface of the at least one element of the actuator assembly and an interior wall of the implantable device defining a boundary of the internal volume, and the internal volume is devoid of gas at a second location defined by all locations along a second direct line between a second surface of the at least one second element of the actuator assembly and the interior wall of the implantable device defining the boundary of the internal volume.

15. The implantable device of claim 14, wherein:

a material is located between a surface of the at least one element of the actuator assembly and an interior wall; and the material is displaced upon movement of the at least one element towards the interior wall such that the material moves in a direction substantially normal to the direction of movement of the element towards the interior wall of the device.

16. The implantable device of claim 14, wherein:

a material is located between a surface of the at least one element of the actuator assembly and an interior wall; and the device is configured such that the material is displaced with movement of the at least one element towards the interior wall of the device such that the movement is dampened.

17. The implantable device of claim 14, wherein:

a material is located between a surface of the at least one element of the actuator assembly and the interior wall; and the material is a filler material that at least partially fills the internal volume between the element and the interior wall of the device.

18. The implantable device of claim 14, wherein:

the implantable device is a hearing prosthesis configured to evoke a hearing percept in an ear in a recipient with a fully intact ossicle in that ear.

19. The implantable device of claim 14, wherein:

the internal volume is also devoid of solids at the second location defined by all locations along the second direct line between the second surface of the at least one second element of the actuator assembly and the interior wall of the implantable device defining the boundary of the internal volume.

20. An implantable device implantable in a recipient, comprising:

a hermetically sealed housing; and an actuator, the actuator including a component to which electricity is applied to actuate the actuator, wherein the implantable device includes at least one element displaceable relative to the housing upon actuation of the actuator, a liquid is inserted between an interior wall of the implantable device that is fixed relative to the housing and the at least one element displaceable relative to the housing, and the component to which electricity is applied is in a same enclosed volume as the liquid.

21. The implantable device of claim 20, wherein:

the liquid is inserted prior to hermetically sealing of the housing.

22. The implantable device of claim 20, wherein:

the liquid is a silicone based liquid.

23. The implantable device of claim 20, wherein:

the actuator is a piezoelectric actuator.

24. The implantable device of claim 20, wherein:

the device is configured such that vibrations travel from inside the housing to outside the housing via a path that is solid.

25. The implantable device of claim 20, wherein:

the implantable device is a transcutaneous bone anchored hearing device.

26. The implantable device of claim 20, wherein:

the hermetically sealed housing establishes a hermetically sealed internal volume;

the actuator assembly includes a transducer element;

the internal volume totally confines the liquid and the transducer element within the volume.

27. The implantable device of claim 20, wherein:

the at least one element is part of the actuator.

28. The implantable device of claim 20, wherein:

the at least one element is a separate component from the actuator.

29. The implantable device of claim 20, wherein:

the liquid is entirely contained in the hermetically sealed housing.

30. The implantable device of claim 20, wherein:

the device is configured such that force generated by actuation of the actuator travels from inside the housing to outside the housing via solid body force transfer.

31. The implantable device of claim 20, wherein:

the device is configured such that force generated by actuation of the actuator travels from inside the housing to outside the housing via a non-fluidic system.

32. An implantable device implantable in a recipient, comprising:

a sealed housing;

an actuator assembly positioned in the housing and having at least one element displaceable relative to the housing; and a displaceable material that is located between an interior wall of the device and a component of the actuator assembly, wherein the component of the actuator assembly is displaceable relative to the interior wall of the device, and wherein the displaceable material is displaced upon movement of at least a portion of the actuator assembly relative to the interior wall of the device, wherein the implantable device is a transcutaneous bone anchored hearing device; and the implantable device is an implantable prosthesis.

33. The implantable device of claim 32, wherein:

the displaceable material dampens a frequency response of the actuator assembly; and actuator assembly includes a piezoelectric actuator.

34. An implantable device implantable in a recipient comprising:

a sealed housing;

an actuator assembly positioned in the housing and having at least one element displaceable relative to the housing; and a displaceable material that is located between an interior wall of the device and a component of the actuator assembly, wherein the component of the actuator assembly is displaceable relative to the interior wall of the device, and wherein the displaceable material is displaced upon movement of at least a portion of the actuator assembly relative to the interior wall of the device, wherein the displaceable material is a damper material configured to dampen movement of the actuator assembly; and the implantable device is configured to transfer energy from the inside the housing to outside the housing via a path separate from the displaceable material to evoke a hearing percept.

* * * * *